United States Patent [19]

Dietrich

[11] Patent Number: 4,689,974

[45] Date of Patent: Sep. 1, 1987

[54] SKIN HOLDER IN AN APPARATUS FOR LETTING OUT SKINS

[75] Inventor: Herbert Dietrich, Kaiserslautern, Fed. Rep. of Germany

[73] Assignee: Pfaff Industriemaschinen GmbH, Fed. Rep. of Germany

[21] Appl. No.: 854,322

[22] Filed: Apr. 21, 1986

[30] Foreign Application Priority Data

Apr. 22, 1985 [DE] Fed. Rep. of Germany ..... 3514466

[51] Int. Cl.[4] ..... C14B 15/00; C14B 17/06

[52] U.S. Cl. ..... 69/27; 69/40; 69/47

[58] Field of Search ..... 69/22, 27, 40, 44, 47

[56] References Cited

U.S. PATENT DOCUMENTS 4,416,125 11/1983 Dietrich ..... 69/27 X 4,620,427 11/1986 Dietrich et al. ..... 69/47

*Primary Examiner*—Wm. Carter Reynolds

*Attorney, Agent, or Firm*—McGlew and Tuttle

[57] ABSTRACT

A skin holding device on an apparatus for letting out skins is driven by drive devices to follow the treatment and feed tools acting on the skin, so that the skin zone received in the skin holding device is moved synchronously with the skin zone gripped by the treatment and feed tools. In this way a skin, when being let out, can neither be distorted nor can it deviate from its initial angular alignment.

8 Claims, 11 Drawing Figures

SKIN HOLDER IN AN APPARATUS FOR LETTING OUT SKINS

FIELD AND BACKGROUND OF THE INVENTION

The present invention relates in general to skin or hide processing equipment, and in particular to a new and useful device for holding the end of a skin which is being let out.

An apparatus for letting out skins is disclosed in U.S. Pat. No. 4,416,125. When a skin is let out, the skin is parted by means of a parting sword obliquely to its lateral edges and subsequently divided into two parts. Then a so-called backspacing is carried out, in that one skin portion is laterally offset relative to the other. Thereafter the skin parts are sewn together again, whereupon the skin is displaced crosswise to the cutting direction to perform the next cut. These operations are repeated until the entire skin has been let out.

During the letting out process, the skin is held by two clamping jaws cooperating like pliers and movable relative to each other in lengthwise direction. After the sewing, the skin is seized at the seam protrusion by a gripper and displaced on the table boards crosswise to the parting sword and hence crosswise to the seam direction, to carry out the next letting out operation. Thereafter, the return movement is carried out, i.e. the gripper moves the skin parallel to the cutting line, to obtain a constant distance between the sewing machine and the respective seam start at the skin.

Now it is an essential prerequisite for a satisfactory work result that in the fully let out skin, all seams run parallel. This means that during the letting out process the angle between the skin edges and the parting sword or respectively the gripper, must not change. For this purpose, a weight has heretofore been hooked to the rear end of each skin, making use of a clasp and a cord. The cord is guided between pairs of a plurality of pins arranged side by side, in such a way that the cord runs essentially parallel to the center line of the skin, so that a pull in longitudinal direction is exerted on the skin.

It has been found that the initial angular position of the connecting cord may have to be corrected several times during the treatment of a skin by rehanging it between different pins, because due to the different thickness between the dorsal and the belly portions and because of uneven distribution of the sweat glands, each skin has sectionwise an irregular stretch behavior and hence the tendency to become distorted during processing.

SUMMARY OF THE INVENTION

It is the object of the invention to provide an apparatus which will ensure that during processing the skin is neither distorted nor deviates from its angular alignment with the parting sword.

Accordingly an object of the present invention is to provide an improvement in an apparatus for letting out skins or hides wherein the skins are cut and sewn at seam areas extending in a longitudinal direction and at an angle to an edge of the skin, the apparatus comprising a pair of clamping jaws for clamping the skin at each seam area, jaw drive means for moving the jaws laterally of the longitudinal direction to clamp the skin at each seam area, a parting sword movable between the jaws and extending in the longitudinal direction, sword drive means connected to the sword for moving the sword in the longitudinal direction to form a furrow and upwardly to push the skin at each seam area between the jaws, cutting means for cutting the seam area after it is clamped by the clamping jaws, a sewing machine for sewing the seam areas, a seam gripper for gripping the seam after it is sewn by the sewing machine and moving the seam downwardly of the clamping jaws and laterally of the longitudinal direction by a seam spacing amount corresponding to a distance between adjacent seam areas on the skin, and gripper drive means moving the seam gripper upwardly and downwardly and laterally of the longitudinal direction for repositioning the skin to bring an additional seam area thereof into alignment with the parting sword, the improvement comprising holding means for holding an end of the skin spaced from the seam areas and which is connected by switchable drives and guides with the sword and gripper drive means in such a way that the skin end received in the holding device is made to follow the seam areas which are being held, cut, sewn together and moved.

By the positive drive movements of the holding device, which isochronically coincide with the movements of the treatment and feed tools acting on the skin, both as to direction and essentially also as to amount, the skin zone clamped in the holding device is made to follow directly the skin zone momentarily seized by the treatment and feed tools, so that no distortion of any kind can ever occur between these two skin zones.

In an especially simple construction of the drive system for the holding device, the drive for the support movable in cross slide fashion is taken off from the feed device of the gripper and the clamp seizing the skin is moved on the one hand by the drive device associated with the first slide and, on the other hand, jointly with said drive device, by the drive device associated with the second slide. If the drive device associated with the second slide is designed as a stepping mechanism whose step size corresponds to the amount of seam loss, the drive device associated with the first slide may be designed as a simple reversible drive whose feed amount is the same in both directions. Seam loss means the shortening of the skin sections inevitably occurring when the upwardly bent cut edges are sewn together.

Making the drives adjustable, the movements of the clamp can be adapted to the differences in skin extraction movement and seam loss caused by different skin thicknesses.

A further object of the invention is to provide the holding device for means with a holding support which contains two slides, one of the slides being movable by a pneumatic cylinder which is alternatively controlled by the parting sword drive means and the gripper drive means, the pneumatic cylinder acting on the second slide, and the first slide also including a further drive in the form of another pneumatic cylinder which is controlled by the gripper drive means alone.

This results in an especially simple construction in terms of control, in that the corresponding drive devices are jointly controlled in synchronism with the drive of the parting sword and of the gripper.

A further object of the invention is to provide an improvement in an apparatus for letting out skins which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The invention is now elucidated with reference to an embodiment illustrated in the drawings wherein.

DESCRIPTION OF THE PREFERRED EMBODIMENT

Figure 1:
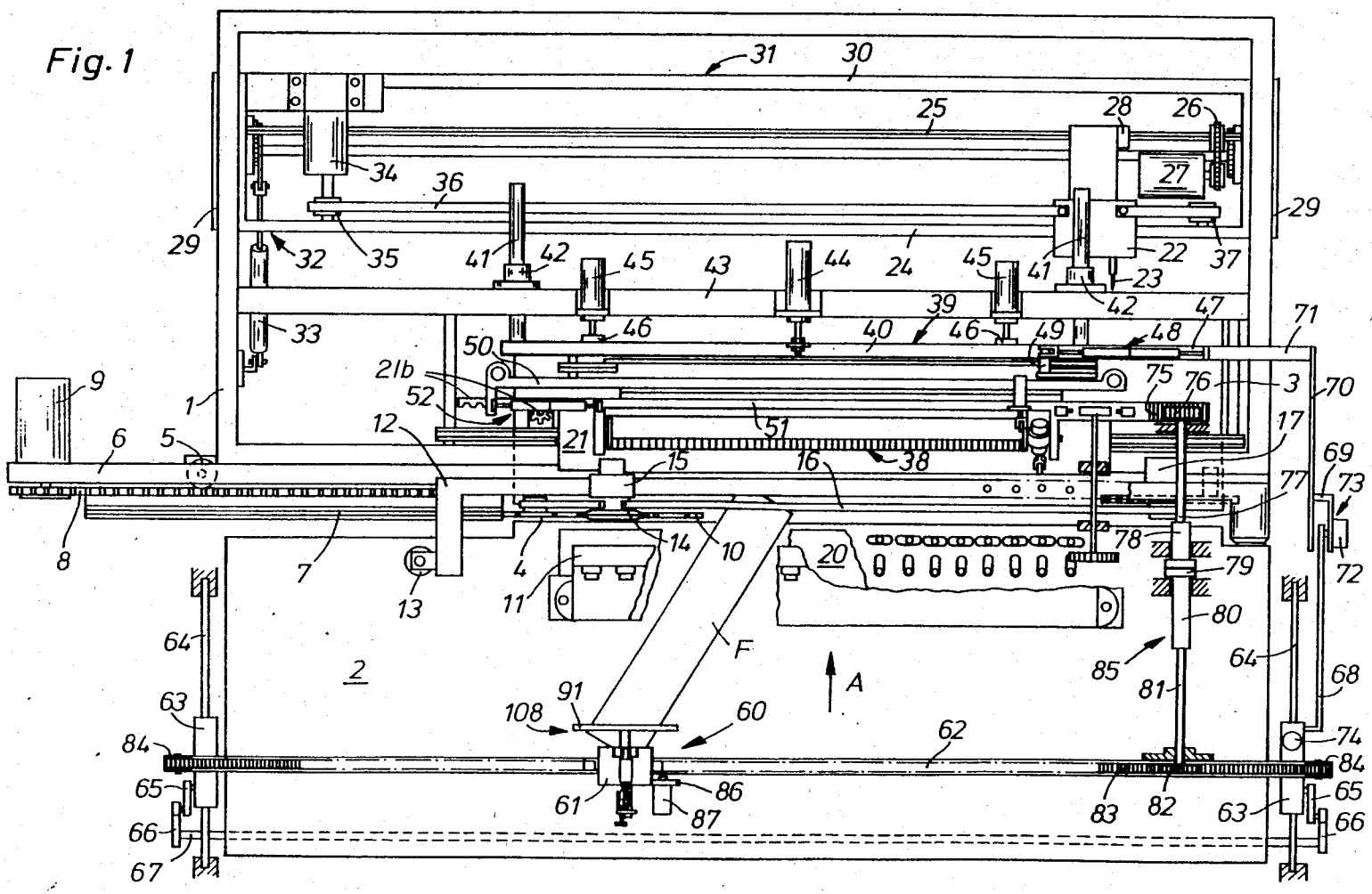
FIG. 1 is a top plan view of the letting apparatus.

In its essential construction the apparatus corresponds to the apparatus illustrated and described in U.S. Pat. No. 4,476,725. As shown in FIG. 1, a rack 1 carries a front bearing plate 2 and a rear bearing plate 3. The two bearing plates 2,3 are separated from each other by a slit 4. On a support 6, movable up and down by a drive 5 (FIG. 1 only a pneumatic cylinder is shown) there is mounted a parting sword 7 displaceable in lengthwise direction inside the slit 4, which sword is in drive connection through a chain 8 with a brake motor 9 fastened on the support 6 Drive 5 and chain 8 with motor 9 together form sword drive means for sword 7. At its front end the parting sword 7 carries a comb type skin divider 10 extending parallel thereto. Associated with the parting sword 7 is an elongated hold-down 11 which extends parallel thereto and which can be moved by means (not shown) from the position shown in FIG. 1, in which it is recessed crosswise to slit 4 and raised, toward the parting sword 7, being at the same lowered.

Pivotably mounted on rack 1 is a guide rod 12, which oscillates up and down by means of a pneumatic cylinder 13 disposed on rack 1 in a manner not explained in detail. A cutting device 15 equipped with a circular cutter 14 is slidably mounted on guide rod 12. Fastened on the cutting device 15 is a toothed belt 16 which is driven by a motor 17.

Figure 5:
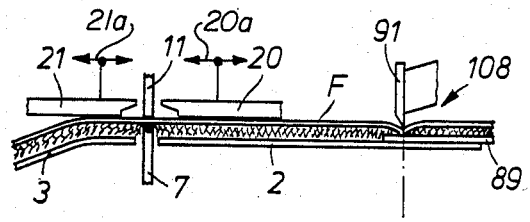
FIGS. 5 to 10 are diagrams illustrating the successive work phases.

With respect to the feed direction of skin F marked by the arrow A, the apparatus contains a front clamping jaw 20 and a rear clamping jaw 21. Both clamping jaws 20, 21 are movable back and forth by means (shown schematically as double arrows 20*a* and 21*a* in FIG. 5) like the corresponding clamping jaws of the apparatus according to the aforesaid patents in a horizontal plane crosswise to the lengthwise direction of the parting sword 7. The rear clamping jaw 21 is moreover displaceable in a horizontal plane parallel to the lengthwise direction of the parting sword 7 by means shown at 21*b* in FIG. 1.

The sewing machine 22 serving to sew the skin parts together (FIG. 1) has a needle 23 movable back and forth in a horizontal plane. The sewing machine 22 is mounted for displacement on a guide bar 24 extending parallel to the parting sword 7 in a horizontal plane and on a toothed shaft 25 parallel to said guide bar. Via a chain transmission 26 the toothed shaft 25 is connected to a brake motor 27 and drives via an internally toothed engaging wheel 28 the mechanism (not shown) of the sewing machine 22. The guide bar 24 and the toothed shaft 25 are arranged in two slides 29 which are mounted on rack 1 and are movable crosswise to the parting sword 7. The slides 29 are joined together by a fixed rod 30 and form with it a frame 31. For the movement of frame 31 a drive mechanism 32 is used which comprises a pneumatic cylinder 33. Fastened on frame 31 is a step motor 34 34 which drives a toothed belt 36 by way of a gear 35. Belt 36 runs over a guide wheel 37 mounted on frame 31 and is firmly connected to the sewing machine 22.

To advance the skins a feed device 39 provided with a gripper 38 is used, which is constructed like the feed device according to the above-mentioned patents. Accordingly the feed device 39 comprises a support plate 40 which by means of guide rods 41 is displaceably mounted in bearings bushings 42 of a longitudinal strut 43 of rack 1. Secured on strut 43 is a pneumatic cylinder 44, the piston rod of which is firmly connected to the support plate 40. On strut 43 are secured two further pneumatic cylinders 45, each of whose piston rods carries a stop plate 46.

At a bracket 47 secured to the support plate 40, a drive device 48 is disposed which consists of two singly controllable pneumatic cylinders connected in series and which are connected via lever linkage 49 with a guide plate 50 mounted for vertical displacement. On guide plate 50 a slide 51 displaceable parallel to the parting sword 7 is arranged. Slide 51 is driven by a drive device 52 which consists of two singly controllable pneumatic cylinders connected in series. On slide 51 is arranged the gripper 38 which is switchable between a closed and an open position.

The skin holding device 60 according to the invention comprises a support 61 which is mounted for displacement on a guide tube 62 extending parallel to the parting sword 7.

The guide tube 62 is mounted through two sleeves 63 for displacement on two guide rods 64 which extend in a horizontal plane crosswise to the longitudinal axis of the parting sword 7. The two sleeves 63 are connected via link 65 for each and a crank 66 with a common shaft 67. At one sleeve 63 an angularly bent rod 68 is fastened which protrudes by its free end into a fork 69 formed at a rod 70. Rod 70 is disposed at a rod-shaped extension 71 which is fastened on the side of the support plate 40. At fork 69 a pneumatic cylinder 72 is fastened whose piston rod presses, when the cylinder is pressurized, the end of rod 68 against the end of rod 70 and establishes in this manner a nonpositive engagement connection. The structural elements 68 to 72 form a drive device 73 for the guide tube 62 and for the support 61 disposed on it. One one of the sleeves 63 a single-action pneumatic cylinder 74 is arranged, whose piston rod presses, when the cylinder is pressurized, against the guide rod 64 and thereby fixes the position of sleeve 63 and of guide tube 62.

On slide 51, a laterally protruding rack rod 75 is fastened. Meshing with the rack 75 is a pinion 76, which is secured on a multi-spline shaft 77. Pinion 76 and shaft 77 are arranged in such a way that they participated in the execution of the shift movement of the feed device 39 occurring crosswise to the parting sword 7. The multi-spline shaft 77 is arranged for displacement in a corresponding multi-spline sleeve 78, which is connected to one coupling side of a switchable magnetic clutch 79. The other coupling side of the magnetic clutch 79 is connected to a multi-spline sleeve 80, in which a multi-spline shaft 81 is displaceable. On the free end of the multi-spline shaft 81 a pinion 82 is fastened which is connected via a mount on guide tube 62 with the guide tube 62 in axial direction and therefore participates in the movements thereof. Pinion 82 meshes with a toothed belt 83 which is passed over two guide wheels 84 disposed at the ends of the guide tube 62, the upper section of belt 83 lying on the top side of guide tube 62 and the lower section running inside the guide tube 62. Toothed belt 83 is secured on support 61 (see also FIGS. 2 to 4). The structural elements 75 to 84 form a drive device 85 for support 61. At a shoulder 86 of support 61 a single action pneumatic cylinder 87 is secured, whose piston rod presses, when the cylinder is pressurized, against the guide tube 62 and thereby secures the position of support 61.

Figures 2, 3, 4:
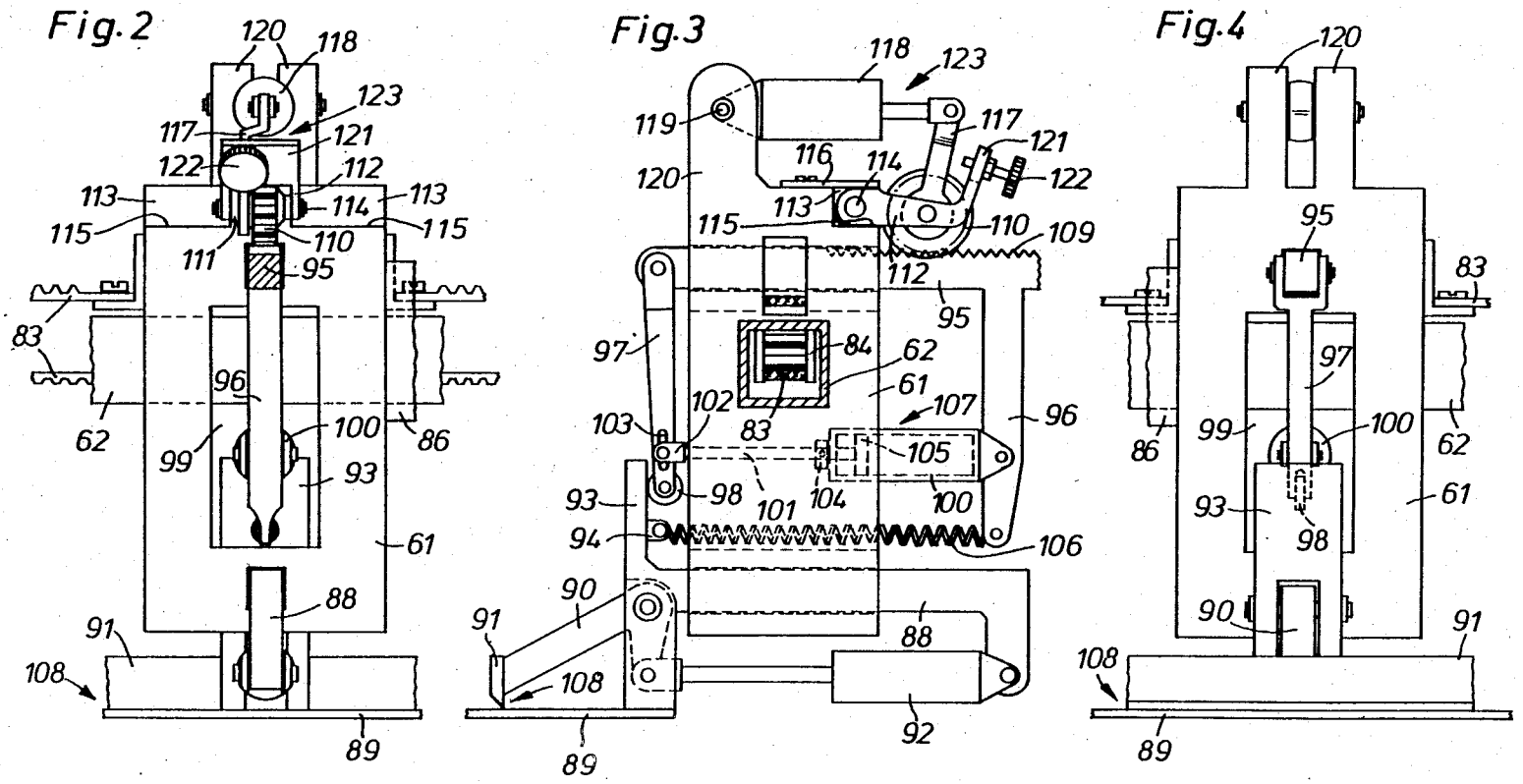
FIG. 2 is a front view of the support and of the slides of the holding device.
FIG. 3 is a side view of the support and of the slides of the holding device.
FIG. 4 is a back view of the support and of the slides of the holding device

In support 61 a slide 88 displaceable crosswise to the longitudinal axis of the parting sword 7 is arranged (FIG. 3). Slide 88 carries a flat support plate 89 resting on the bearing plate 2. At slide 88 an angle lever 90 is pivotably mounted which carries a wise stirrup 91 and is connected to the piston rod of a pneumatic cylinder 92 on slide 88. On slide 88 an upwardly protruding stop piece 93 is formed which carries an eye 94.

In support 61, above guide tube 62, a slide 95 disposed parallel to slide 88 is mounted which carries a downwardly protruding projection 96. At the front end of slide 95 a lever 97 is pivotably mounted which carries at its free end a roller 98. At the projection 96, a pneumatic cylinder 100 passed through a continuous cutout 99 in support 61 is arranged, whose piston rod 101 is articulated to lever 97 by a fork head 102. Due to a slot 103 formed in lever 97, the hinge point of piston rod 101 is adjustable. As shown in FIG. 3, a setting ring 104 is fastened on the piston rod 101 in such a way that piston 105 can execute only a comparatively short stroke. A tension spring 106, attached at one end to the free end of projection 96 and at the other end in eye 94, causes the roller 98 always to apply against the stop piece 93. The structural elements 97 to 106 form a drive device 107 for slide 88 and for the skin clamp 108 formed by the support plate 89 and stirrup 91. Adjustment to the hinge point of piston rod 101 in slot 103, adjust the stroke of slide 88.

A portion of the top side of slide 95 is formed as a rack rod 109. Meshing with rack 109 is a pinion 110 which, together with a oneway coupling 111 connected with it, is mounted in a forked rocker 112. Rocker 112 is pivotably mounted in two cutouts 113 in support 61 on a bolt 114 and braces itself against the horizontal limiting walls 115 of the cutouts 113. A swiveling latch 116 holds rocker 112 in the operating position shown in FIGS. 2 and 3. At the oneway coupling 111 a crank 117 is fastened. At crank 117 the piston rod of a pneumatic cylinder 118 is articulated which is pivotably mounted by means of a bolt 119 between two projections 120 of support 61. At an angularly bent end portion 121 of rocker 112 a setting screw 122 is disposed which serves as adjustable stop for crank 117 and in this way limits the stroke of pneumatic cylinder 118. The structural elements 110 to 122 form a drive device 123 for slide 95.

The apparatus operates as follows:

A skin F to be let out is placed hair side down on the bearing plates 2,3, the long edge L of skin F turned toward the sewing machine 22 which is in inactive position (FIG. 11) being aligned at an acute angle marked $\alpha$ (alpha) to the cutting line S of the cutting device 15. Then the rear end of skin F is placed into the opened skin clamp 108, which is closed by pressurizing the pneumatic cylinder 92. Thereafter the hold-down 11 is lowered onto skin F and the parting sword 7 with the skin divider 10 is moved by the brake motor 9 from the inactive position shown in FIG. 1 into the operating position, the parting process being carried out on skin F. During the parting process, the skin section in contact with the skin divider 10 and with the parting sword 7 remains in the starting position. During this time, the guide tube 62 and the support 61 are retained in their starting position by the pneumatic cylinders 74 and 87 acting as clamps, and the drive devices 107, 123 remain not actuated, so that skin clamp 108 remains in its starting position, too.

Figure 6:
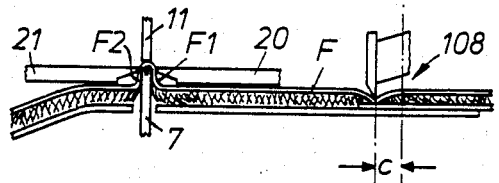

As soon as the parting sword 7 is in the parting furrow drawn in the parting process, it is raised by the stroke drive 5 to the level of the clamping jaws 20, 21 (FIG. 6), forming a fold in skin F. During the fold formation, the skin sections lying before and behind the parting sword 7 are displaced by the amount c in the direction of the parting sword 7. This horizontal movement of the skin sections is referred to as skin extraction movement. Simultaneously with the pressurization of the pneumatic cylinders of the stroke device 5, through the same control elements (not shown), pneumatic cylinder 100 is pressurized, which thereupon pivots the lever 97. The swivel movement of lever 97 is transmitted via roller 98 to the stop 93, whereby slide 88 with the skin clamp 108 is displaced in the direction of the parting sword 7. The stroke of pneumatic cylinder 100 and the position of the hinge point of the forked head 102 at lever 97 are chosen so that the displacement path of skin clamp 108 in FIG. 6 corresponds exactly to the amount c of the skin extraction movement.

Figure 7:
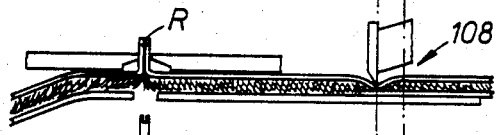
Figure 8:
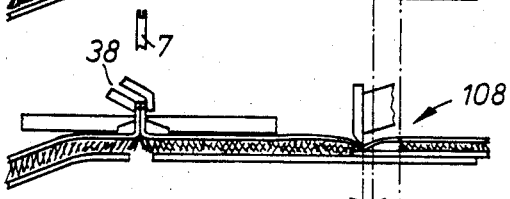

After the parting sword 7 has completed its upward movement, the two clamping jaws 20, 21 are moved toward each other, so that they clamp the skin F between them and the parting sword 7. Thereafter skin F is cut by the cutting device 15. Following this, by displacement of the rear clamping jaw 21 the so-called back-spacing is carried out at the two skin parts and the parting sword 7 is lowered to below the bearing plates 2,3 again. Then the two skin parts are sewn together again with the aid of the sewing machine 22. As the seam N is formed at the upwardly bent abutting cut edges, resulting in a seam rib R, (FIG. 7) there occurs a shortening of the skin parts, referred to as seam loss (FIG. 8). The amount d of seam loss is generally about 2 mm. However, it may vary depending on the skin thickness.

The skin parts having been sewn together, the gripper 38 is moved toward the seam rib R pressurizing the pneumatic cylinder 44 as well as the drive device 48. During the movement of gripper 38 crosswise to the parting sword, rod 70 shifts relative to rod 68, but without taking the latter along. For this reason, support 61 remains in its starting position during this displacement of gripper 38. But during the lowering of gripper 38, the pneumatic cylinder 118 is pressurized via the same control elements (not shown). As a result, crank 117 is pivoted to abutment against the setting screw 122. The swivel movement of crank 117 is transmitted via the one-way coupling 111 to pinion 110, which thereupon displaces slide 95 by an amount corresponding of the amount d of seam loss in the direction of the parting sword 7. The displacement movement of slide 95 is transmitted to slide 88 via the lever 97 bracing itself against the housing of pneumatic cylinder 100 by means of setting ring 104, and thereby slide 88 is displaced together with its drive device 107 and with the skin clamp 108 by the same amount and in the same direction (FIG. 8).

Pneumatic cylinder 118 is immediately reversed, crank 117 being thus pivoted back to its starting position. In this pivoting direction of crank 117 there occurs in the one-way coupling 111 an idle stroke, so that the slides 95,88 and hence also the skin clamp 108 remain in their advanced position.

Figure 9:
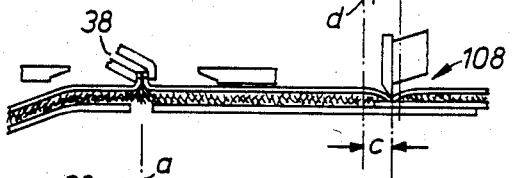

As soon as gripper 38 has seized the seam rib R, gripper 38 is again lowered by further pressurization of drive device 48, namely until the fold formed by the parting sword 7 has been eliminated. Of the two fold sections F1, F2 liberated with the lowering of gripper 38, the rear section F2 is drawn off in forward direction A (FIG. 1) by a transport device device described in U.S. Pat. No. 4,620,427. The front fold section F1, on the other hand, is drawn off by pullback of the skin clamp 108. To carry out this pullback movement of the skin clamp 108, pneumatic cylinder 100 is reversed by the control elements (not shown) which bring about the second lowering of gripper 38, i.e. the pneumatic cylinder is pressurized so that it pulls the lever 97 back toward support 61. At that, the tension spring 106 holds stop 93 in abutment on roller 98, whereby the skin clamp 108 is pulled back again, namely by the same amount corresponding to amount c (FIG. 9).

Figure 10:
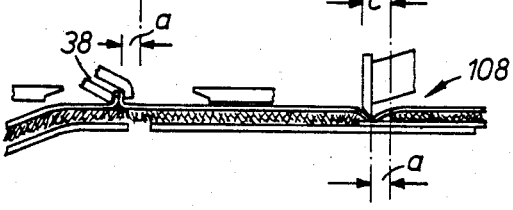
Figure 11:
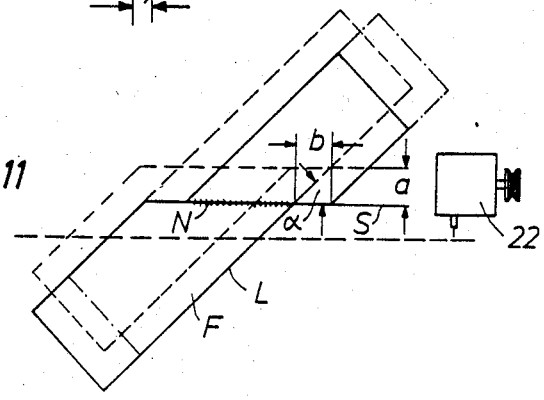
FIG. 11 is a representation of several movement cycles of a skin.

Thereafter pneumatic cylinder 44 is pressurized in the opposite way, whereby it moves gripper 38 away from the parting sword 7 until support plate 40 strikes against the stop plates 46. During this movement of the closed gripper 38, the skin F is displaced crosswise to the longitudinal axis of the parting sword 7 and hence crosswise to the seam N (FIG. 10). The position of the stop plates 46 determines the amount of transverse movement of gripper 38 and hence of transverse advance of skin F or respectively the seam spacing a (FIGS. 10 and 11). Simultaneously with pneumatic cylinder 44 also pneumatic cylinder 72 is pressurized, whereby it establishes a non-positive connection between the two rods 68 and 70. Thus the transverse displacement of gripper 38 is transmitted via the rods 68, 70 to the right sleeve 63 (FIG. 1). The displacement of the right sleeve 63 is transmitted to the shaft 67 without delay, by way of the right link 65 and the right crank 66 and from there to the left sleeve 63, by way of the left crank 66 and the left link 65, causing the left sleeve 63 to be moved synchronously with the right sleeve 63. This displacement of the sleeves 63 closes displacement of the tube 62 and hence the support 61 and the skin clamp 108, whereby the latter is displaced in the direction of the parting sword 7 by an amount corresponding to the distance a or respectively is moved along with gripper 38 (FIG. 10).

After the transverse movement of gripper 38, slide 51 and hence also gripper 38 are displaced parallel to the longitudinal axis of the parting sword 7 by the drive device 52 for the execution of the return movement by the amount b (FIG. 11). By previous closing of the magnetic clutch 79, the displacement movement of slide 51 is transmitted to support 61 via rack 75 and drive device 85, whereby the skin clamp 108 is moved along with the gripper 38 by an amount corresponding to amount b.

After execution of the return movement a letting out process is completed. The pneumatic cylinders 74 and 87 acting as clamps are pressurized, whereby the position of support 61 is fixed. Further the magnetic clutch 79 is opened, and by venting of the pneumatic cylinder 72 the engagement connection between the rods 68, 70 is released again. Thereupon the next letting out process can be carried out.

After the entire skin F has been let out, rocker 112 is released and the pneumatic cylinders 74 and 87 are vented, whereby the guide tube 62 and support 61 as well as the slide 95 and hence the skin clamp 108 can be moved back to their starting positions.

For the simultaneous working of several skins F, either the skin clamp 108 is widened accordingly or several supports and skin clamps coupled together in terms of movement are provided.

While a specific embodiment of the invention has been shown and described in detail to illustrate the application of the principles of the invention, it will be understood that the invention may be embodied otherwise without departing from such principles.

What is claimed is:

1. In a device for letting out a skin to be cut and sewn at seam areas extending in a longitudinal direction and at an angle to an edge of the skin, the device comprising a pair of clamping jaws for clamping the skin at each seam area, jaw drive means for moving the jaws laterally of the longitudinal direction to clamp the skin at each seam area, a parting sword movable between the jaws and extending in a longitudinal direction, sword drive means connected to said sword for moving said sword in a longitudinal direction to form a furrow and upwardly to push the skin at each seam area between said jaws, cutting means for cutting the seam area after it is clamped by said clamping jaws, a sewing machine for sewing the seam area, a seam gripper for gripping the seam after it is sewn by said sewing machine and moving the seam downwardly of said clamping jaw and laterally of said longitudinal direction by a seam spacing amount corresponding to a distance between adjacent seam areas on the skin, and gripper drive means for moving said seam gripper upwardly and downwardly and laterally of the longitudinal direction for repositioning the skin to bring an additional seam area thereof into alignment with said parting sword, the improvement comprising holding means for receiving an end of at least one skin spaced from the seam areas, guide means for guiding the holding means for movement in the longitudinal direction and laterally of the longitudinal direction, and switchable drive means connected to said holding means for moving said holding means along said guide means for following movements of the seam areas of the skin due to said sword and gripper drive means.

2. In a device of claim 1, the improvement including said switchable drive means having skin extraction means for moving said holding means on said guide means laterally of said longitudinal direction by a skin extraction amount corresponding to an amount of lateral movement in the skin caused by said parting sword when it is moved upwardly to push the skin in each seam area between said jaws by said sword drive means, and seam loss means for moving said holding means on said guide means toward said seam area by a seam loss amount corresponding to the lateral movement of the skin due to gripping and sewing of the seam area.

3. In the device of claim 2, wherein said gripper drive means moves said seam gripper parallel to said longitudinal direction by a return amount, the improvement including said switchable drive means comprising return means for moving said holding means along said guide means in said longitudinal direction corresponding to said return an amount of movement of said gripper by said gripper drive means.

4. In a device according to claim 3, the improvement wherein said holding means comprises a support, a first slide slidably mounted to said skin support for movement laterally of the longitudinal direction, a skin clamp for clamping the end of the skin spaced from said seam areas, said skin clamp being connected to said first slide for movement therewith, a second slide mounted for movement laterally of the longitudinal direction on said support, said switchable drive means comprising first drive operatively connected between said first and second slides for moving said first slide with respect to said second slide, and a second drive operatively connected between said second slide and said support for moving said second slide in respect to said support.

5. In the device of claim 4, the improvement comprising connecting drive means for interconnecting said holding means with said gripper drive means for moving said holding means on said guide means along with movement of said seam gripper and for disconnecting said gripper drive means from said holding means for permitting movement of said seam gripper without movement of said holding means.

6. In the device of claim 5, the improvement comprising said first and second slides and said first and second drives being adjustable for changing said skin extraction and seam loss amounts.

7. In the device of claim 4, wherein said improvement includes a first pneumatic cylinder operatively connected to said sword drive means for moving said first slide by the skin extraction amount with movement of said parting sword upwardly to push the seam area between said jaws, said seam loss means comprising a second pneumatic cylinder connected to said second slide for moving said second slide by said seam loss amount, said second pneumatic cylinder being operatively connected to said gripper drive means.

8. In the device of claim 7, the improvement wherein said guide means comprises a guide tube, said support being mounted for movement parallel to the longitudinal direction on said guide tube, a belt entrained on said guide tube and connected to said support, a shaft operatively connected between said belt and said gripper drive means for moving said belt with movement of said gripper drive means to move said gripper, and said switchable drive means including disconnect means connected in said shaft for disconnecting movement of said gripper from movement of said belt.

* * * * *